United States Patent [19]

Hughes

[11] Patent Number: 4,531,803

[45] Date of Patent: Jul. 30, 1985

[54] ELECTRICAL TERMINAL AND TERMINAL HOUSING FOR MAKING CONNECTIONS TO INSULATED WIRES

[75] Inventor: Donald W. K. Hughes, Mechanicsburg, Pa.

[73] Assignee: AMP Incorporated, Harrisburg, Pa.

[21] Appl. No.: 410,237

[22] Filed: Aug. 23, 1982

[51] Int. Cl.[3] ..... H01R 4/02

[52] U.S. Cl. ..... 339/97 R

[58] Field of Search ..... 339/97 R, 97 P, 98, 339/99 R, 221 R, 221 M

[56] References Cited

U.S. PATENT DOCUMENTS

| | | | |
|---|---|---|---|
| 3,838,203 | 9/1974 | Brandlein et al. | 339/221 M |
| 4,026,013 | 5/1977 | Hughes | 339/276 R |
| 4,118,103 | 10/1978 | Leidy et al. | 339/98 |
| 4,130,331 | 12/1978 | Neff et al. | 339/97 R |
| 4,152,686 | 5/1979 | Hughes | 336/192 |
| 4,153,326 | 5/1979 | Frantz et al. | 339/99 R |
| 4,183,607 | 1/1980 | Hughes | 339/97 R |
| 4,212,509 | 7/1980 | Brooks et al. | 339/97 R |

FOREIGN PATENT DOCUMENTS

| | | | |
|---|---|---|---|
| 1264562 | 3/1968 | Fed. Rep. of Germany . | |
| 2743242 | 3/1978 | Fed. Rep. of Germany | 339/97 R |

*Primary Examiner*—Gil Weidenfeld
*Assistant Examiner*—Gary F. Paumen
*Attorney, Agent, or Firm*—F. W. Raring; Robert W. J. Usher

[57] ABSTRACT

Electrical terminal comprises first and second plate members joined by an integral bight. A wire-receiving slot extends into one of the plate members and an enlarged clearance opening is provided in the other plate member. The terminal is adapted to be inserted into a cavity in a housing having wire-admitting slots which permit placement of a wire in the slots with the wire extending through the cavity. A rib is provided in the cavity which is received in the clearance opening in the other plate member, the rib having a wire supporting surface at its upper end. The terminal is produced from dual thickness material with the first plate member and a major portion of the second plate member being of material of reduced thickness. Parts of the one plate member are a relatively thick stock metal and the free end of the other plate member is against the relatively thick stock metal. The wire-receiving slot is a sheared slit and the terminal is intended to make connections to relatively fine wires.

9 Claims, 8 Drawing Figures

ELECTRICAL TERMINAL AND TERMINAL HOUSING FOR MAKING CONNECTIONS TO INSULATED WIRES

FIELD OF THE INVENTION

This invention relates to electrical terminals and terminal housings for forming connections to insulated wires, particularly wires having varnish type insulation thereon. The embodiment of the invention described below is particularly intended for forming connections to extremely fine wires, however, the principles of the invention can be used to establish contact with relatively coarse wires.

BACKGROUND OF THE INVENTION

U.S. Pat. No. 4,130,331 discloses an electrical terminal and a terminal housing for establishing an electrical contact with insulated wires, particularly wires having thin varnish type insulating coatings such as polyvinyl formal resin coatings which are used for coil windings. The terminal of the above identified U.S. Patent comprises a pair of plate-like members in side-by-side parallel relationship which are connected at corresponding ends by an integral bight. An opening is provided in the bight and wire-receiving slots extend inwardly in the plate-like sections from the opening. The housing has a terminal receiving cavity. Aligned wire-admitting slots in the housing permit placement of a wire in the wire-admitting slots with an intermediate portion of the wire extending through the cavity. A wire supporting surface is provided in the cavity which supports the wire and is dimensioned to enter the opening in the bight. Electrical contact to the wire is established by placing the wire in the wire-admitting slots and then inserting the terminal into the cavity so that the wire is received in the wire-receiving slots of the terminal.

Terminals and terminal housings of the general type disclosed in U.S. Pat. No. 4,130,331 have been widely adopted in the electrical industry for making electrical connections to wires, particularly wires extending from electrical coils. In most instances, the terminals and housings have been dimensioned and designed to make electrical contact with AWG30 wires (having a diameter of 0.25 mm) or wires more coarse than AWG30. It has been found to be impractical to exploit the principles of the invention discussed in U.S. Pat. No. 4,130,331 in making electrical connections to wires finer than AWG30 wires. Wires finer than AWG30 are relatively flimsy and it has been found to be impractical to produce a wire-receiving slot in the terminal which will accept the wires and establish electrical contact without shearing the wire or damaging it to the extent that the resulting electrical connection is not reliable. It would be desirable to apply the principles of the invention of the above identified patent to AWG40 or 41 wires, for example. An AWG41 gauge wire, however, has a diameter of 0.07 mm and the varnish type insulation on a wire of this gauge is 0.01 mm or less. It can be readily appreciated then that an AWG41 gauge wire is extremely delicate and must be handled with great care and finesse when an electrical connection is being made thereto in order to avoid breaking of the wire while the connection is being made. The present invention is directed to the achievement of an electrical terminal and a terminal housing which is effective to establish contact with wires as fine as AWG41 gauge as well as wires of a more coarse gauge.

The invention comprises an electrical terminal and a terminal housing, the terminal being of the type comprising first and second plate-like members in side-by-side relationship which are joined at corresponding ends by an integral bight. A wire-receiving slot extends into the bight and partially along the length of the terminal. The housing has a terminal receiving end and first and second external sidewalls extending from the terminal receiving end. A terminal receiving cavity extends inwardly from the terminal receiving end and has opposed first and second cavity sidewalls which are proximate to the first and second external sidewalls respectively. First and second wire-admitting slots extend inwardly from the terminal receiving end, the first wire-admitting slot intersecting the first external sidewall and the first cavity sidewall, the second wire-admitting slot intersecting the second external sidewall and the second cavity sidewall. A wire supporting surface is provided in the cavity for supporting a wire positioned in the wire-admitting slots with a portion of the wire extending through the cavity. The terminal and housing are particularly characterized in that a rib is provided in the cavity which is spaced from the second cavity sidewall and proximate to the first cavity sidewall. One end of the rib is adjacent to the inner end of the first wire-admitting slot and the wire supporting surface is on the one end of the rib. The rib extends further into the cavity and has a side surface portion which is spaced from, and extends alongside, the second cavity sidewall. The bight of the first plate-like member has a clearance opening therein which is dimensioned to receive the side portion of the rib. The distance between the side portion of the rib and the second cavity sidewall is sufficient slideably to receive the second plate-like member. The wire-receiving slot is provided in the second plate-like member so that upon placement of the wire in the wire-admitting slots and insertion of the terminal into the cavity, a portion of the wire which extends from the wire supporting surface to the second cavity sidewall is received in the wire-receiving slot.

In accordance with further embodiments, the rib is integral with the first cavity sidewall and the wire supporting surface is recessed inwardly from the one end of the rib, the rib having convergent wire guiding surfaces on each side of the wire supporting surface. In accordance with a further embodiment, the terminal comprises an elongated section of dual thickness material, the first plate-like section, the bight, and a major portion of the second plate-like section being of material of reduced thickness, the remainder of the second plate-like section being of relatively thicker material. In accordance with a further embodiment, the terminal is double ended and has a lead wire connecting member extending from the second plate-like member. In accordance with a further embodiment, the wire-receiving slot comprises a slit produced by shearing the second plate-like member.

Figure 1:
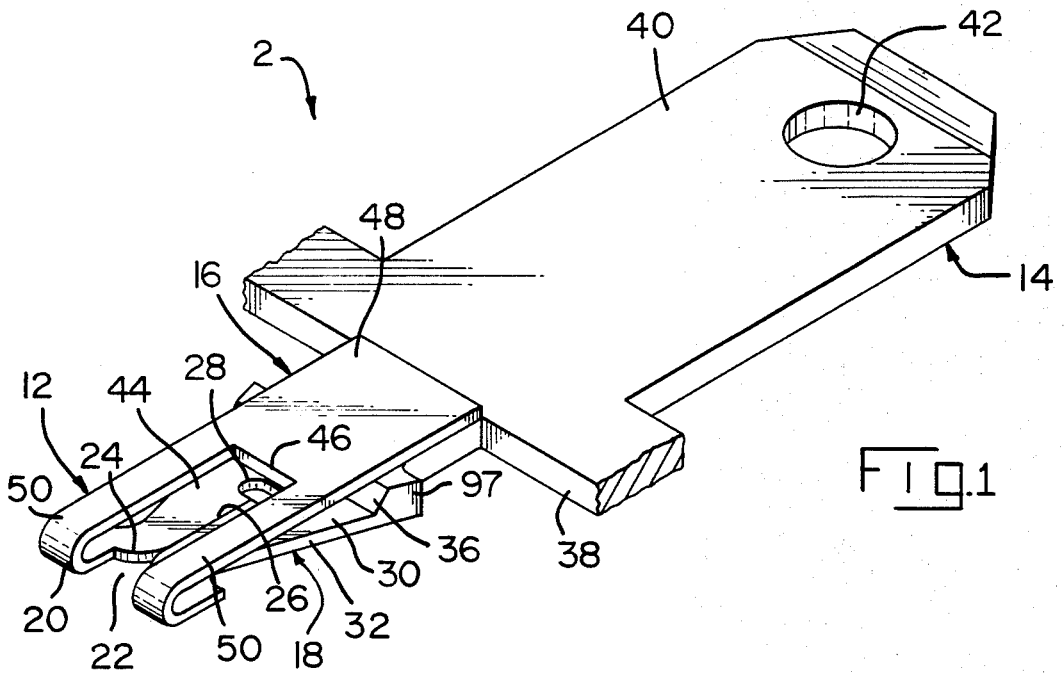
FIG. 1 is a perspective view of a terminal in accordance with the invention.

The disclosed embodiment comprises a terminal 2 and a terminal receiving housing 4 used to form an electrical connection to a wire 6. The disclosed embodiment is particularly intended for use with extremely fine wires, for example AWG40 or AWG41 wires. A wire of this gauge may extend from the windings 8 of a relatively small coil wound on a bobbin 10, see FIG. 7.

The terminal 2 has wire connecting means at one end 12 for forming the connection to the wire 6 and has a terminal tab at its other end 14 by means of which connection can be made to a lead wire. The connecting means at the lower end 12 comprises first and second plate-like members 16, 18 which are in side-by-side parallel relationship and are connected by an integral bight section 20. An enlarged opening 22 is provided in the bight and extends into both of the plate-like members 16, 18. In the plate-like member 18, the opening has convergent side edges 24 which lead to a wire receiving slot 26 at the inner end of which there is provided a punched hole 28. The slot 26 is produced by shearing the blank of the terminal, as will be described below, without the removal of material. The slot 26 will therefore be extremely narrow and will have a width that is hardly measurable. The wire-receiving slot 26 divides the lower portion of the plate-like member into two sections 30 which move apart when the wire is inserted into the slot. These two sections 30 have convergently tapered outside edges 32 and each section can thereby be considered to be a tapered beam. The degree of convergence of edges 32 will in part determine the flexure characteristics of beams and it can therefore be modified to produce in the terminal the required resistance to flexure for the wire to which connection is being made.

Figure 2:
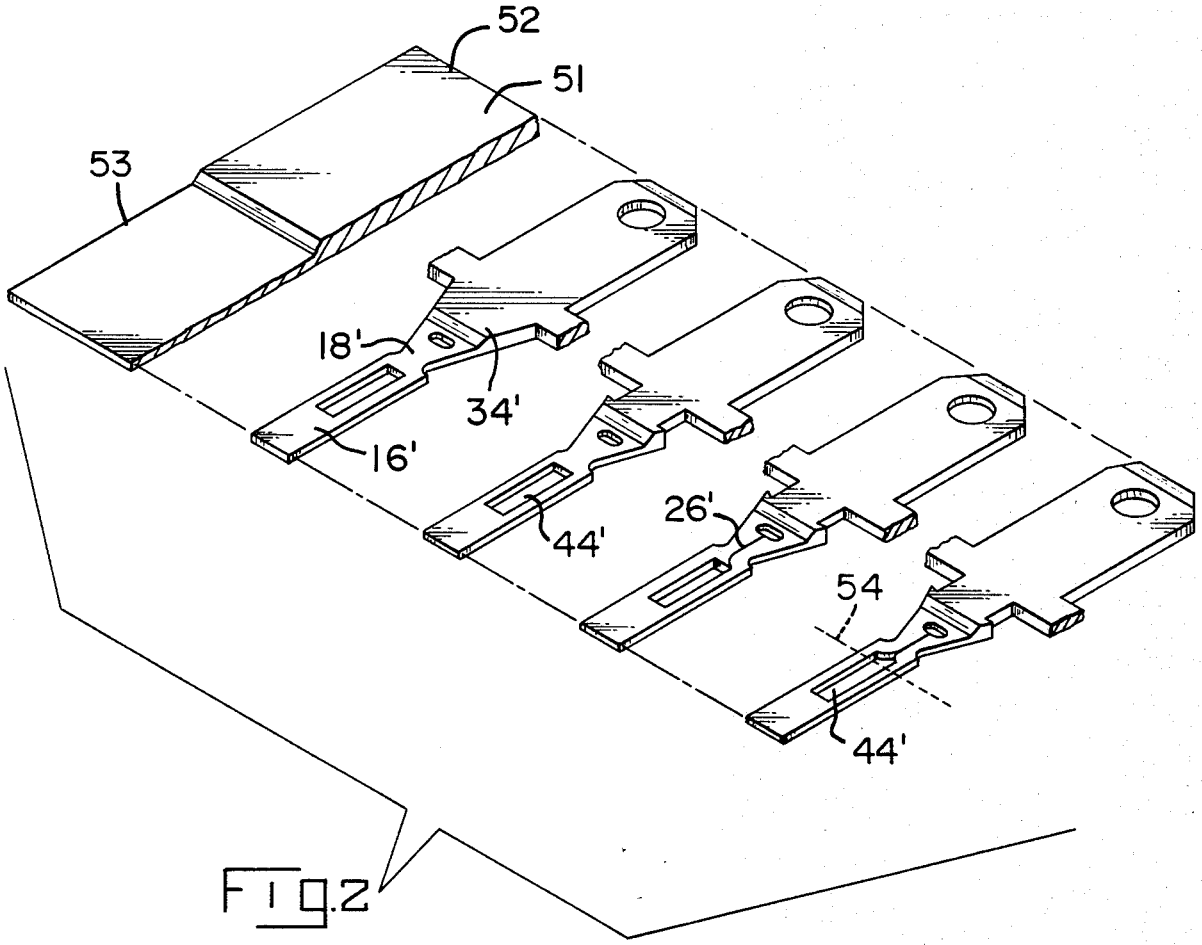
FIG. 2 is a series of views illustrating the manner of producing the terminal by stamping and forming operations.

The terminal is produced from dual-thickness sheet metal 52 (FIG. 2). As a result, the upper portion 34 of the second plate-like member 18 and the entire upper portion of the terminal have a thickness which is substantially greater than the thickness of the lower part of the lower portion of the plate-like member 18 and the first plate-like member 16. The transition zone is defined by a ramp 36 on the underside of the second plate-like member as viewed in FIG. 3. Dual thickness material 52 is used in order to provide a thick upper section 14 and a lower section 12 of thin metal stock which is suitable for extremely fine wires.

Figure 5:
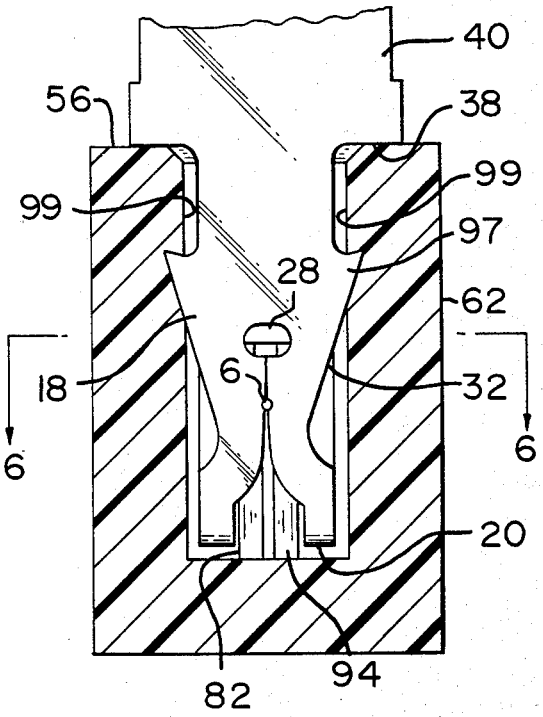
FIG. 5 is a view similar to FIG. 4 showing a terminal fully inserted into the terminal receiving cavity.

The upper portion 34 of the second plate-like member merges with the tab portion 40 of the terminal and downwardly facing shoulders 38 are provided at the juncture of the upper and lower portions which function as stops when the terminal is inserted into the housing as shown in FIG. 5. The tab 40 may be dimensioned to be mated with a terminal receptacle on the end of a lead wire or may have other connecting means as desired. For example, the upper portion of the terminal can be provided with a U-shaped crimp barrel or a wire can be soldered to the upper portion by means of a punched hole 42 therein.

The first plate-like member 16 has an enlarged clearance opening 44 which extends in the first plate-like member to a location 46 beyond the punched hole 28 in second plate-like member. The first plate-like member has a free end portion 48 which extends parallel to, and is against the relatively thick section 34 of the second plate-like member. The first plate-like member therefore has spaced-apart straps 50 which extend from the free end 48 to the bight 20 of the terminal.

The terminal 2 is produced by stamping and forming dual thickness metal strip 52 as shown in FIG. 2. In FIG. 2, the parts of the terminal blanks are indicated with the same reference numerals, differentiated by prime marks, as are used above in the description of the finished terminal. While the partially formed blanks are shown as separated blanks in FIG. 2, it will be understood that the terminals are produced in a stamping and forming die as a continuous strip with each terminal integral with a continuous carrier strip. The final forming step to produce the terminal requires bending of the blank along a bend line 54 to produce the plate-like members of the finished terminal.

Figure 7:
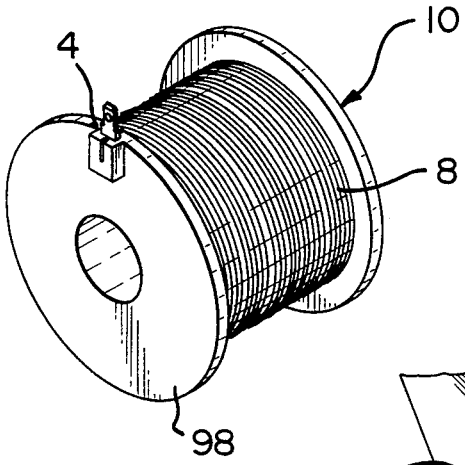
FIG. 7 is a perspecive view showing a coil bobbin having a terminal housing in accordance with the invention integral with one of its flanges.
Figure 8:
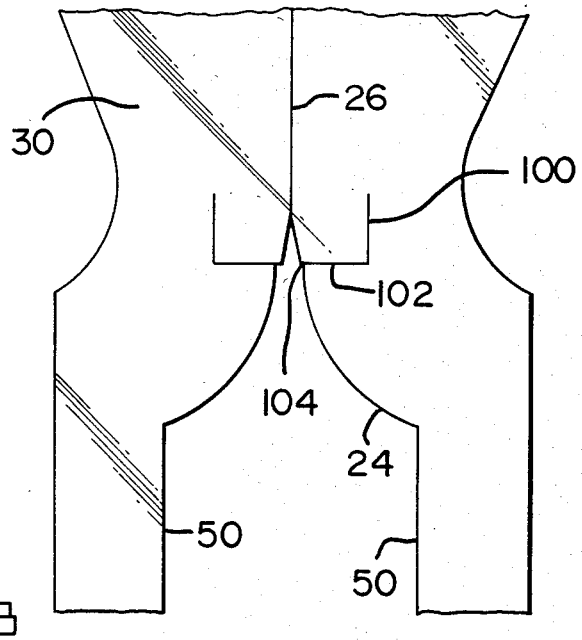
FIG. 8 is a fragmentary view showing a wire-receiving slot having an insulation stripping shoulder means.

The terminal housing 4 is produced by molding and may be formed integrally with one of the flanges 98 of the coil bobbin 10 as shown in FIG. 7. The housing has a terminal receiving end 56, oppositely facing first and second external sidewalls 58, 60 and oppositely facing external endwalls 62. A terminal receiving cavity 64 extends inwardly from the terminal receiving end 56 and has opposed first and second cavity sidewalls 66, 68 which are proximate to the external sidewalls 58, 60. First and second wire-admitting slots 70, 72 extend inwardly from the terminal receiving end 56, the first wire-admitting slot 70 intersecting the first external sidewall 58 and the first cavity sidewall 66 and the second wire-admitting slot intersecting the second cavity sidewall 68 and the second external sidewall 60. Each slot has a relatively wide entrance portion 74 and is provided with inclined wall portions 76 so that the width of each slot is progressively reduced as the inner end of the slot is approached. The inner ends of the slots 78, 80 are relatively narrow and a wire positioned on these inner ends will be accurately located with a portion of its length extending through the cavity and supported on a wire supporting surface 88 described below.

Figure 3:
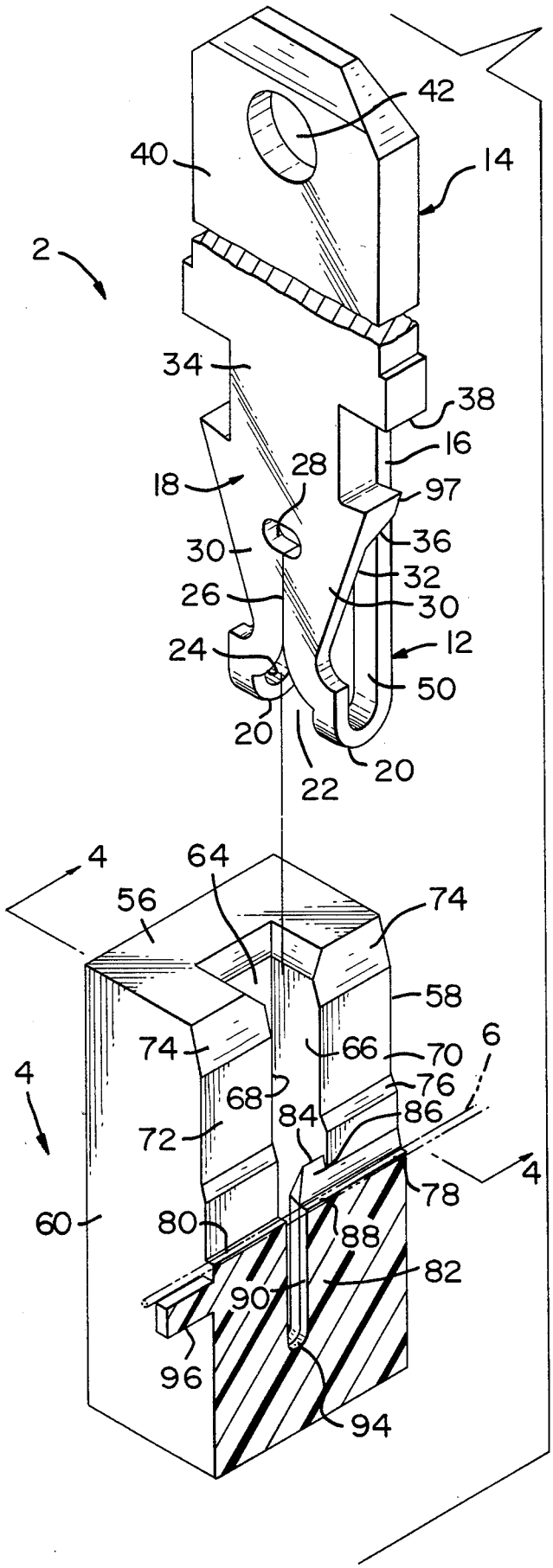
FIG. 3 is a perspective view showing a half-section of the terminal housing and showing a terminal in alignment with the terminal receiving cavity of the housing.
Figure 4:
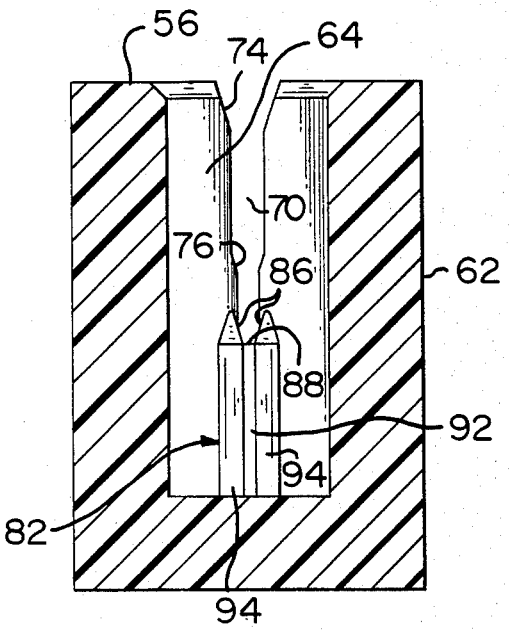
FIG. 4 is a sectional view of the terminal housing looking in the direction of the arrows 4—4 of FIG. 3.

A rib 82 is provided in the cavity and is formed integrally with the cavity sidewall 66. This rib extends from the inner end of the cavity to a location slightly above the inner end 78 of the slot 70. The upper end 84 of the rib is provided with a recess having convergently inclined sidewalls 86 which extend towards the wire supporting surface 88. It will be apparent that as the wire is moved downwardly into the slots, it will be guided progressively by the sides of the slots towards the surfaces 86 which in turn will accurately position the wire on the surfaces 78, 80, and 88 as shown in FIG. 3.

Figure 6:
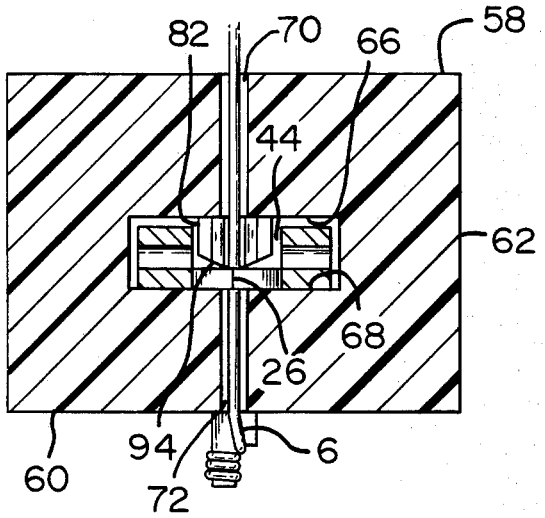
FIG. 6 is a view taken along the lines 6—6 of FIG. 5.

The rib 82 is spaced from the cavity sidewall 68 and has a side portion 92 which is beveled as shown at 94, see FIG. 6. The rib is dimensioned such that it can be received in the clearance opening 44 in the plate-like member 16 and the distance between the rib and the cavity sidewall 68, shown at 94 in FIG. 3, is sufficient to receive the plate-like member 18 of the terminal.

An integral winding post 96 is provided on the external sidewall 60 adjacent to the inner end 80 of the wire-admitting slot 72. After the wire has been positioned in the wire-admitting slot, the end portion of the wire is wrapped around the post 96. When the terminal is inserted into the cavity, the post 96 is sheared off by a shearing blade and the wire is trimmed at the end of the slot 72.

In use, after the wire has been wound on the coil bobbin 10, the end portion of the wire is passed downwardly into the wire-admitting slots 70, 72 and wound around the post 96. The winding and wire positioning operations can be carried out by an automatic coil winding machine. Thereafter, a terminal 2 is positioned above the cavity 64 in the orientation shown in FIG. 3 and inserted into the cavity. The lances 97 on the side edges of the plate-like member 18 will penetrate the endwalls 99 of the cavity and retain the terminal therein. As the terminal moves into the cavity, the portion of the wire extending across the clearance space 94 will be received in the wire-receiving slot 26 and the edges of this slot will penetrate the varnish type insulation of the wire and establish electrical contact. The rib will be received in the clearance opening 44 as shown in FIG. 6 and the terminal is thereby accurately guided into the cavity and its position is stabilized.

Under some circumstances the varnish type insulation on the wire will be penetrated without difficulty by the opposed edges of the slit-like wire-receiving slot 26. If difficulty in penetrating the insulation is encountered, a narrow shoulder 104 can be provided on each side of the entrance to the slot 26. This shoulder is produced by shearing the sections 30 of the plate-like member 18 along shear lines 100, 102 thereby to form a tab that is bent out of the planes of the sections 30. The tabs are then bent back into the planes of the sections 30 and the engagement of the sheared surfaces with each other causes the sheared sections to move towards each other. This technique of providing very narrow shoulders is described in U.S. Pat. No. 4,183,607. Shoulders having a width of only 0.013 mm or less can be produced by this technique.

Terminals and housings in accordance with the invention can be made in different sizes for different gauge wires. The principles of the invention are particularly advantageous in the manufacture of relatively small terminals intended to establish contact with the wires in the range of about AWG34–AWG41 or finer. A terminal in accordance with the invention which can be used with AWG40 wires is produced from milled brass having a normal thickness of 0.51 mm in the thick section 51 of the strip 52 and having a thickness of about 0.15 mm in the milled section 53. After forming, the terminal has an overall length from the bight 20 to the upper end of the tab 14 of about 1 cm and a height of the plate-like sections 16, 18 as measured from the bight 20 is about 4.45 mm. The terminal housing is proportionately as small as the terminal and requires only a minimum amount of space in the bobbin flange 98 in FIG. 7. In fact, the housing cavity is so small that it can sometimes be contained entirely in the bobbin flange and it is not necessary that the housing protrude beyond the surface of the flange as shown for purposes of illustration in FIG. 7.

Although the stock thickness of plate-like sections 16, 18 is only about 0.15 mm, the lower portion of the terminal is nonetheless relatively sturdy and is resistant to damage from routine handling. The sturdyness of the terminal results from the fact that the free end 48 of the plate-like member 16 is disposed against the relatively thick strip metal of the upper end of the plate-like member 18. The plate-like member 16 supports the two sections 30 of the plate-like member 18 and prevents damage to them prior to insertion of the terminal into a cavity. At the same time, the sections 30 will move apart under controlled conditions when the wire 6 is received in the slot 26.

A salient advantage of the invention is a relative fine wire can be accurately placed in the housing as shown in the housing and the terminal accurately guided into engagement with the wire to establish electrical contact. The contact force is produced entirely by stresses in the terminal and does not depend upon any part of the plastic housing for its maintenance.

Terminals in accordance with the invention are capable of accepting a range of wire gages and the terminal can be delicately adjusted or "fine tuned" by making relatively minor changes in dimensions. For example, as it is designed to reduce the force required to spread the sections 30 of the plate-like member 18 (in order to render the terminal suitable for an extremely fine and fragile wire), the taper on the side edges 32 of the sections 30 can be increased so that the beams formed by the sections 40 will deflect under a lower force. The sizes of the clearance opening 44 can be increased with a resulting reduction in the width of the strap members 50. This change would reduce the restraining effect of strap members 50 on the sections 30 and thereby reduce the force required to spread the sections 30 of plate member 18. Since the dual thickness strip 52 is produced by milling a strip of uniform thickness, the thickness of the reduced section 53 can be increased or decreased with precision during the milling step and a slight change in the thickness of the section 53 may have a significant effect on the mechanical characteristics of the terminal.

Terminals in accordance with the invention can be used with relatively more coarse wires than those discussed above and the advantages of the invention will be obtained.

I claim:

1. An electrical terminal housing for forming an electrical connection to at least one wire, the terminal being of the type comprising first and second plate-like members in side-by-side relationship which are joined at corresponding ends by an integral bight, a wire-receiving slot extending into the bight and partially along the length of the terminal, the housing having a terminal-receiving end and having first and second external sidewalls extending from the terminal-receiving end, a terminal-receiving cavity extending inwardly from the terminal-receiving end, the cavity having opposed first and second cavity sidewalls which are proximate to the first and second external sidewalls respectively, first and second wire-admitting slots extending inwardly from the terminal-receiving end, the slots having closed inner ends, the first wire-admitting slot intersecting the first external sidewall and the first cavity sidewall, the second wire-admitting slot intersecting the second external sidewall and the second cavity sidewall, and a wire supporting surface of in the cavity for supporting a wire positioned in the wire-admitting slots with a portion of the wire extending through the cavity, the terminal and housing being characterized in that:

a rib is provided in the cavity which rib is spaced from the second cavity sidewall and integral with and extending from the first cavity sidewall, one end of the rib being adjacent to the inner end of the first wire admitting slot, the wire supporting surface being on the one end of the rib, the rib extending further into the cavity from the one end and having a side surface portion which is spaced from and extends alongside, the second cavity sidewall, the wire-receiving slot is formed as a sheared slit provided in the second plate-like member, the bight and the first plate-like member having an elongate clearance opening therein which is dimensioned to receive the rib, the clearance opening extending longitudinally of the first plate-like member in alignment with the sheared slit in the second plate-like member, the distance between the side surface portion of the rib and the second cavity sidewall being sufficient to slidably receive the second plate-like member, whereby, upon placement of the wire in the wire-admitting slots and insertion of the terminal into the cavity, the rib is received in the bight and the clearance opening with the wire supporting surface aligned with the sheared slit and a portion of the wire which extends from the wire supporting surface to the second cavity sidewall will be received in the sheared slit and the wire will thereby be connected to the terminal.

2. An electrical terminal and a terminal housing as set forth in claim 1 characterized in that the wire supporting surface is recessed inwardly from the one end of the rib and the rib has convergent wire guiding surfaces on each side of the wire supporting surface.

3. An electrical terminal and a terminal housing as set forth in claim 1 or claim 2 characterized in that the terminal is a double ended terminal, the plate-like members being one end of the terminal, at least one of the plate-like members having an extension constituting the other end of the terminal, the other end having a lead wire connecting member thereon.

4. An electrical terminal and a terminal housing as set forth in claim 3 characterized in that the lead wire connecting member comprises a tab.

5. An electrical terminal and a terminal housing as set forth in claim 3 characterized in that the terminal comprises an elongate section stamped from dual-thickness material, the other end of the terminal having a thickness which is greater than the thickness of the one end of the terminal.

6. An electrical terminal and a terminal housing as set forth in claim 5 characterized in that the other end of the terminal extends from the second plate-like member, the first plate-like member having a free end portion which is substantially against a portion of the greater thickness material.

7. An electrical terminal of the type comprising first and second plate-like members in side-by-side relationship which are joined at corresponding ends by an integral bight, a wire-receiving slot extending into the bight and partially along the length of the terminal whereby upon relative movement of a wire into the wire-receiving slot, the opposed edges of the slot will establish electrical contact with the wire, the terminal being characterized in that:

the terminal comprises an elongate section stamped from dual thickness material, the first plate-like member, the bight and a major portion of the second plate-like member being of material of reduced thickness, the wire-receiving slot formed as a sheared slit extending into the second plate-like member, the second plate-like member having an increased thickness portion beginning at a location spaced from the bight, the slot having an inner end which is located between the increased thickness portion and the bight, the first plate-like member having a free end portion which is substantially parallel to, and substantially against, the increased thickness portion of the second plate-like member, the first plate-like member having a clearance opening therein extending in alignment with the sheared slit from the bight to a location opposite to the inner end of the wire-receiving slot whereby sections of the second plate-like member defining opposite edges of the slot are moved laterally away from each other by relative movement of a wire into the wire-receiving slot, the opposed edges of the slot electrically contacting the wire, portions of the first plate-like member on each side of the clearance opening serving to control the lateral movement of the sections of the second plate-like member.

8. An electrical terminal as set forth in claim 7 characterized in that an extension is provided in the increased thickness section of the second plate-like member, the extension having a lead wire connecting member for forming an electrical connection to a lead wire.

9. An electrical terminal as set forth in claim 8, the lead wire connecting member being a tab.

* * * * *